US005265834A

United States Patent [19]

Daniels

[11] Patent Number: 5,265,834

[45] Date of Patent: Nov. 30, 1993

[54] NURSER BOTTLE HOLDER

[76] Inventor: Donis Daniels, 355 Old Country Rd., Fairfield, N.J. 07004

[21] Appl. No.: 959,790

[22] Filed: Oct. 13, 1992

[51] Int. Cl.[5] ..... A47D 15/00

[52] U.S. Cl. ..... 248/104; 24/302; 248/314

[58] Field of Search ..... 248/100, 103, 104, 105, 248/106, 107, 311.2, 314; 215/11.1; 220/737, 741, DIG. 2; 24/302, 298, 301

[56] References Cited

U.S. PATENT DOCUMENTS

| | | | |
|---|---|---|---|
| 2,539,698 | 1/1951 | Pearson | 248/104 |
| 2,893,672 | 7/1959 | Vardan | 248/102 |
| 3,977,638 | 8/1976 | Woodard | 248/102 |
| 4,718,623 | 1/1988 | McClure | 248/102 |
| 4,844,399 | 7/1989 | Harm | 248/311.2 |
| 4,989,811 | 2/1991 | Millis et al. | 248/104 |

*Primary Examiner*—Ramon O. Ramirez
*Attorney, Agent, or Firm*—Anthony F. Cuoco

[57] ABSTRACT

A holder for an infant nurser bottle includes an elongated strap-like member which is formed at one end so as to be looped around a securing member and formed at the other end so as to cooperate with a lower bottle girdling strap secured thereto to provide a harness for nesting the bottom and lower circumference of the bottle. An upper girdling strap is secured to the elongated strap-like member for girdling the upper circumference of the bottle.

7 Claims, 3 Drawing Sheets

NURSER BOTTLE HOLDER

BACKGROUND OF THE INVENTION

This invention relates to a holder for a nurser bottle and, more particularly, to a holder of the type described which attaches to a supporting member for preventing the bottle from falling away when dropped or tossed by an infant using the bottle for self-nursing purposes.

Upon reaching a certain age, most infants are able to grasp a nurser bottle for self-nursing purposes. Under these circumstances, it is not uncommon for the infant to drop the bottle or, indeed, to toss the bottle away. This necessitates retrieving the bottle and cleaning and/or sterilizing at least the nipple portion thereof to avoid contamination, which would be detrimental to the infant's health and well being.

A device on the market for avoiding the above consequences features an elongated strap-like member formable at one end in a loop for attachment to a supporting member on a car seat or carriage, or indeed on the infant's hand. The other end of the strap is formable to retain an adapter which fits over the neck portion of the bottle.

The problem with this device is that the nurser bottle cap which retains the bottle nipple therein must be removed before the adapter can be disposed on the neck portion of the bottle, after which the cap is replaced for retaining the adapter in position and for rendering the bottle useful for nursing. This leads to excessive handling which can easily contaminate the bottle nipple and contents, and is thus less than desireable for the reasons aforenoted.

The present invention overcomes this disadvantage as will be discerned from the disclosure thereof which follows.

SUMMARY OF THE INVENTION

This invention contemplates a nurser bottle holder featuring an elongated strap-like member formable at one end in a loop for attaching the bottle holder to a supporting member. The other end of the elongated strap-like member is arranged in cooperation with a girdling strap to provide a harness for nesting the bottom and the lower circumference of the bottle. Another girdling strap is arranged with the elongated strap-like member in spaced relation to the first mentioned girdling member for girdling the upper circumference of the bottle. The loop portion of the elongated strap-like member is disposed around a securing member so that when the nurser bottle is dropped or tossed by an infant, as the case may be, it can be easily retrieved. The entire bottle holder is of a washable webbing material, such as polypropylene or a suitable cotton blend material, as will be recognized as desireable for the purposes intended.

DETAILED DESCRIPTION OF THE INVENTION

Figure 1:
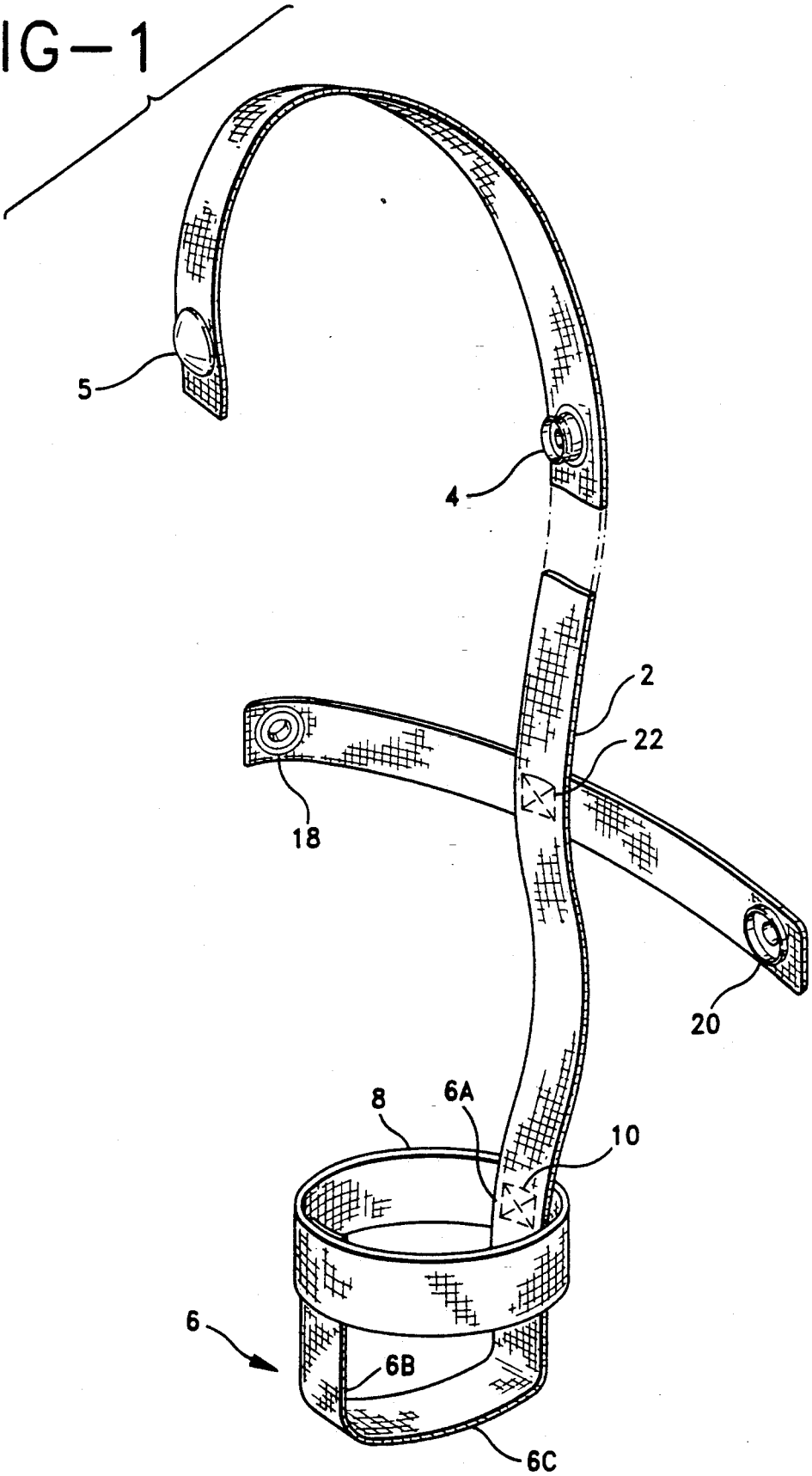
FIG. 1 is an isometric representation illustrating the features of the invention.

With reference to the drawings, an elongated strap-like member is designated by the numeral 2. One end of elongated strap-like member 2 is formable in a loop and for this purpose the one strap end carries male and female snap members 4 and 5, respectively.

The opposite end of elongated strap-like member 2 is formable in a generally U-shaped configuration, designated by the numeral 6, and having legs 6A and 6B and a bottom 6C. A lower girdling strap 8 is symmetrically secured as by a sewn seam 10 to the outer surface of leg 6A of U-shaped configuration 6. Girdling strap 8 is likewise symmetrically secured to leg 6B of U-shaped configuration 6. Thus, U-shaped configuration 6 of elongated strap-like member 2 and lower girdling strap 8 cooperate to provide a harness for nesting bottom 12 and lower circumference 14 of an infant nurser bottle 16, as particularly shown in FIG. 2.

With further reference to FIG. 1, an upper girdling strap is designated by the numeral 14. Upper girdling strap 14 carries male and female snap members 18 and 20 at the opposite ends thereof and is symmetrically secured as by a sewn seam 22 to the outside surface of elongated strap-like member 2 in spaced relation to lower girdling strap 8.

Figure 2:
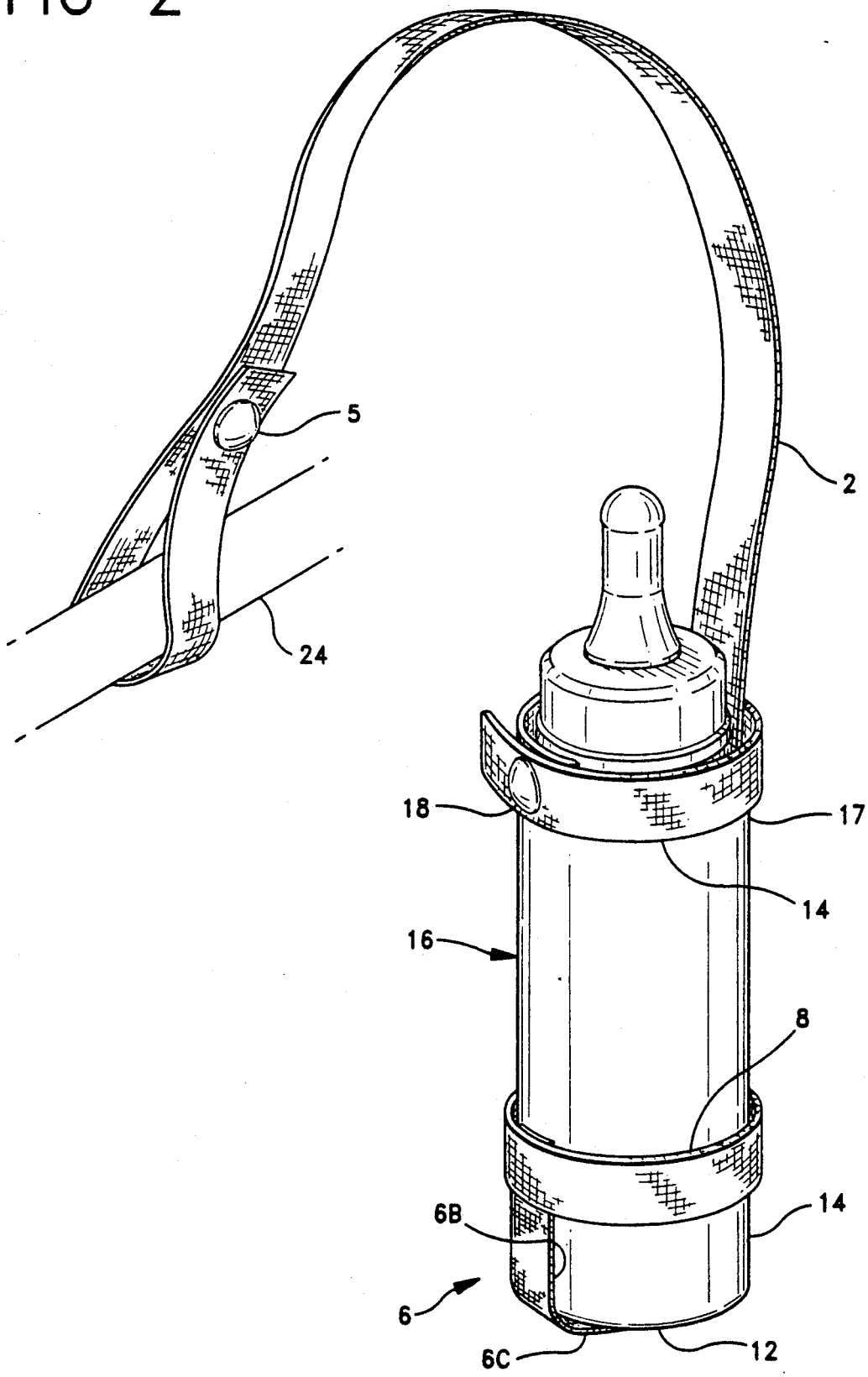
FIG. 2 is an isometric representation illustrating the use of the invention.

With particular reference to FIG. 2, when bottle 16 is nested in the harness formed by U-shaped member 6, including legs 6A and 6B, bottom 6C, and lower girdling strap 8, upper girdling strap 14 is girdled around upper portion 17 of bottle 16 via snap members 18 and 20.

With the arrangement described, bottle 16 is carried in the holder disclosed herein, as is the purpose of the invention.

With continued reference to FIG. 2, the loop-formable end of elongated strap-like member 2, when formed in a loop via snap members 4 and 5, is positioned around a supporting member 24 which may be a member on an infant car seat or carriage, or the like in which an infant is positioned, whereby the purposes of the invention are satisfied.

Figure 3:
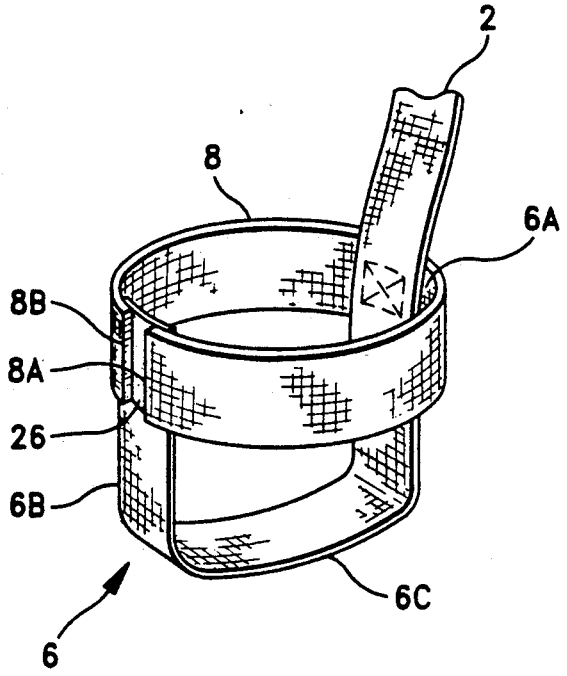
FIG. 3 is a fragmented isometric representation illustrating an alternate embodiment of a harness portion of the invention otherwise illustrated in FIGS. 1 and 2.

With the arrangement so far described, girdling straps 8 and 14 do not accommodate variations in bottle circumference as may occur. This situation is accommodated by an arrangement as shown in FIG. 3.

Thus, leg 6B of U-shaped configuration 6 has either a loop or pile portion on its outside surface which is designated by the numeral 26. Girdling strap 8, rather than being a continuous member as illustrated in the embodiment of the invention shown in FIGS. 1 and 2, has ends 8A and 8B.

The inside surfaces of ends 8A and 8B of girdling member 8 likewise have loop or pile surfaces (not otherwise shown) so as to adjustably engage loop or pile surface 26, as the case may be (commonly referred to as a Velcro fastening). This arrangement provides for adjustment of the circumference of girdling member 8, at least to the extent of the width of leg 6B, whereby bottles of varying lower circumferences 14 are accommodated.

In this connection, and with reference to FIGS. 1 and 2, snap members 18 and 20 on upper girdling member 14 can be replaced with engaging loop and pile members as described above to provide for like adjustment of the circumference of upper girdling member 14, whereby bottles of varying upper circumferences 17 are accommodated. Indeed, snap members 4 and 5 may be replaced with engaging loop and pile members for the purposes described, as will now be appreciated.

It is noted that infant nurser bottles usually have a tapering diameter so as to be larger in diameter at the lower end than at the upper end, and which feature can be easily accommodated by the invention.

The invention herein disclosed features a holder for a nurser bottle used by an infant for self-nursing purposes, so that when the bottle is dropped or tossed by the infant, the bottle may be easily retrieved and is subjected to a minimum of contamination, as will now be appreciated.

In further use of the invention, elongated strap member 8, instead of being wrapped around a supporting member 24 as illustrated in FIG. 2, may be wrapped around the wrist of the infant or, indeed, to a belt or like portion of a garment worn by the infant to insure that the bottle is not dropped or tossed remote from the infant's present location.

The invention described may be constructed of a commercially available, washable webbing material, such as polypropylene or a suitable cotton blend material, so as to enhance its use, as will be readily recognized by those having a need for the device.

With the above description of the invention in mind, reference is made to the claims appended hereto for a definition of the scope of the invention.

What is claimed is:

1. A nurser bottle holder, comprising:

an elongated strap-like member having one end formable as a loop for attaching the bottle holder to a supporting member, and an opposite end formable in a generally U-shaped configuration;

a first girdling member secured to the generally U-shaped configuration and cooperating therewith for providing a harness for nesting the bottom and lower circumference of a nurser bottle;

a second girdling member secured to the elongated strap-like member in spaced relation to the first girdling member, and adapted for being girdled around the upper circumference of the bottle when the bottom and lower circumference thereof are nested in the harness;

the second girdling member having opposite ends and being symmetrically secured to the elongated strap-like member;

each of said opposite ends including means for attaching said each end to the opposite end, whereby the second girdling member is adapted for girdling the upper circumference of the bottle; and the means included on each of the opposite ends for attaching said each end to the opposite end adjustably attach said each end to the opposite end.

2. A nurser bottle holder as described by claim 1, wherein:

the first girdling member is a continuous member.

3. A nurser bottle holder as described by claim 1, wherein:

the one end of the elongated strap-like member carries first means and second means in spaced relation to the first means and engagable therewith, whereby said one end is formable as a loop.

4. A nurser bottle holder as described by claim 2, wherein:

the second girdling member has opposite ends and is symmetrically secured to the elongated strap-like member; and each of said opposite ends including means for attaching said each end to the opposite end, whereby the second girdling member is adapted for girdling the upper circumference of the bottle.

5. A nurser bottle holder as described by claim 4, wherein:

the means included on each of the opposite ends for attaching said each end to the opposite end adjustably attach said each end to the opposite end.

6. A nurser bottle holder as described by claim 5, wherein:

the generally U-shaped configuration includes first and second legs;

the first girdling member has opposite ends, with each of said opposite ends including fastening means;

said first girdling member is symmetrically secured to one of the legs of the generally U-shaped configuration; and the other of the legs of the generally U-shaped configuration including fastening means for adjustably engaging the fastening means on each of the ends of the first girdling member, whereby said first girdling member cooperates with the U-shaped configuration for providing the harness.

7. A nurser bottle holder, comprising:

an elongated strap-like member having one end formable as a loop for attaching the bottle holder to a supporting member, and an opposite end formable in a generally U-shaped configuration;

a first girdling member secured to the generally U-shaped configuration and cooperating therewith for providing a harness for nesting the bottom and lower circumference of a nurser bottle;

a second girdling member secured to the elongated strap-like member in spaced relation to the first girdling member, and adapted for being girdled around the upper circumference of the bottle when the bottom and lower circumference thereof are nested in the harness;

the generallly U-shaped configuration including first and second legs;

the first girdling member having opposite ends, with each of said opposite ends including fastening means;

said first girdling member being symmetrically secured to one of the legs of the generally U-shaped configuration; and the other of the legs of the generally U-shaped configuration including fastening means for adjustably engaging the fastening means on each of the ends of the first girdling member, whereby said first girdling member cooperates with the U-shaped configuration for providing the harness.

* * * * *